US009512536B2

(12) United States Patent
Tatebe et al.

(10) Patent No.: US 9,512,536 B2
(45) Date of Patent: Dec. 6, 2016

(54) METHODS FOR FORMING WHITE ANODIZED FILMS BY METAL COMPLEX INFUSION

(71) Applicant: Apple Inc., Cupertino, CA (US)

(72) Inventors: Masashige Tatebe, Tokyo (JP); Jody R. Akana, San Francisco, CA (US); Takahiro Oshima, Tokyo (JP); Peter N. Russell-Clarke, San Francisco, CA (US); Ayumi Hongou, Kyoto (JP); Kenji Hara, Nara (JP)

(73) Assignee: Apple Inc., Cupertino, CA (US)

( * ) Notice: Subject to any disclaimer, the term of this patent is extended or adjusted under 35 U.S.C. 154(b) by 152 days.

(21) Appl. No.: 14/040,528

(22) Filed: Sep. 27, 2013

(65) Prior Publication Data

US 2015/0090598 A1 Apr. 2, 2015

(51) Int. Cl.

| | |
|---|---|
| ***C25D 11/22*** | (2006.01) |
| ***C25D 11/04*** | (2006.01) |
| ***C25D 11/20*** | (2006.01) |
| ***C25D 11/24*** | (2006.01) |
| *C25D 11/10* | (2006.01) |
| *C25D 11/18* | (2006.01) |

(52) U.S. Cl.

CPC ..... *C25D 11/22* (2013.01); *C25D 11/045* (2013.01); *C25D 11/20* (2013.01); *C25D 11/24* (2013.01); *C25D 11/246* (2013.01); *C25D 11/10* (2013.01); *C25D 11/18* (2013.01); *C25D 11/243* (2013.01)

(58) Field of Classification Search

CPC ..... C25D 11/02; C25D 11/14; C25D 11/18; C25D 11/22

See application file for complete search history.

(56) References Cited

U.S. PATENT DOCUMENTS 2,231,373 A * 2/1941 Schenk ..... 205/50
3,382,160 A * 5/1968 Asada ..... 205/173

(Continued)

FOREIGN PATENT DOCUMENTS

JP 57092194 A * 6/1982
JP 06-057493 3/1994

(Continued)

OTHER PUBLICATIONS

"Theoretical Modelling of Porous Oxide Growth on Aluminum" by Parkhutik et al., J. Phys. D: Appl. Phys. 25, pp. 1258-1263 (1992).*

(Continued)

*Primary Examiner* — Bryan D. Ripa
(74) *Attorney, Agent, or Firm* — Downey Brand LLP

(57) ABSTRACT

The embodiments described herein relate to anodizing and anodized films. The methods described can be used to form opaque and white anodized films on a substrate. In some embodiments, the methods involve forming anodized films having branched pore structures. The branched pore structure provides a light scattering medium for incident visible light, imparting an opaque and white appearance to the anodized film. In some embodiments, the methods involve infusing metal complex ions within pores of an anodized. Once within the pores, the metal complex ions undergo a chemical change forming metal oxide particles. The metal oxide particles provide a light scattering medium for incident visible light, imparting an opaque and white appearance to the anodized film. In some embodiments, aspects of the methods for creating irregular or branched pores and methods for infusing metal complex ions within pores are combined.

21 Claims, 16 Drawing Sheets

(56) References Cited

U.S. PATENT DOCUMENTS

| | | | | |
|---|---|---|---|---|
| 3,524,799 | A * | 8/1970 | Dale | 205/330 |
| 4,526,671 | A * | 7/1985 | Watanabe | C25D 11/24 205/147 |
| 5,218,472 | A | 6/1993 | Jozefowicz et al. | |
| 5,250,173 | A * | 10/1993 | Jozefowicz | 205/121 |
| 5,277,982 | A | 1/1994 | Jozefowicz | |
| 5,510,015 | A | 4/1996 | Martinez et al. | |
| 6,379,523 | B1 | 4/2002 | Takabayashi | |
| 7,173,276 | B2 | 2/2007 | Choi et al. | |
| 7,715,086 | B2 | 5/2010 | Yamamoto et al. | |
| 2008/0274375 | A1* | 11/2008 | Ng et al. | 428/687 |
| 2013/0153428 | A1 | 6/2013 | Akana et al. | |
| 2014/0209467 | A1* | 7/2014 | Miao | C25D 11/04 205/50 |

FOREIGN PATENT DOCUMENTS

| | | | |
|---|---|---|---|
| WO | WO9219795 | | 11/1992 |
| WO | WO 0118281 | A1 * | 3/2001 |
| WO | WO2012119306 | | 9/2012 |

OTHER PUBLICATIONS

Product Data Sheet on titanium dilactate ammonium salt accessed from http://www.sigma-aldrich.com on Jun. 10, 2015.*

English Translation of JP57092194A.*

PCT/US2014/052843. Int'l Search Report & Written Opinion (Dec. 11, 2014).

* cited by examiner

METHODS FOR FORMING WHITE ANODIZED FILMS BY METAL COMPLEX INFUSION

FIELD OF THE DESCRIBED EMBODIMENTS

The described embodiments relate to anodized films and methods for forming anodized films. More specifically, methods for providing anodized films having opaque and white appearances are described.

BACKGROUND

Anodizing is an electrochemical process that thickens and toughens a naturally occurring protective oxide on a metal surface. An anodizing process involves converting part of a metal surface to an anodic film. Thus, an anodic film becomes an integral part of the metal surface. Due to its hardness, an anodic film can provide corrosion resistance and surface hardness for an underlying metal. In addition, an anodic film can enhance a cosmetic appearance of a metal surface. Anodic films have a porous microstructure that can be infused with dyes. The dyes can add a particular color as observed from a top surface of the anodic film. Organic dyes, for example, can be infused within the pores of an anodic film to add any of a variety of colors to the anodic film. The colors can be chosen by tuning the dyeing process. For example, the type and amount of dye can be controlled to provide a particular color and darkness to the anodic film.

Conventional methods for coloring anodic films, however, have not been able to achieve an anodic film having a crisp and saturated looking white color. Rather, conventional techniques result in films that appear to be off-white, muted grey, milky white, or slightly transparent white. In some applications, these near-white anodic films can appear drab and cosmetically unappealing in appearance.

SUMMARY

This paper describes various embodiments that relate to anodic or anodized films and methods for forming anodic films on a substrate. Embodiments describe methods for producing protective anodic films that are visually opaque and white in color.

According to one embodiment, a method for providing an anodic film that reflects nearly all wavelengths of visible light incident on an exposed first surface is described. The anodic film includes a number of pores characterized as having a mean pore diameter and each having an opening at the first surface. The method includes infusing metal ions into the anodic pores by way of the openings at the first surface. The metal ions are characterized as having a mean ion diameter smaller than the mean pore diameter, resulting in the infused metal ions migrating to a pore terminus opposite the opening. The method also involves converting the infused metal ions into larger metal oxide particles characterized as having a size entrapping the metal oxide particles in the pores. The metal oxide particles provide a light scattering medium that creates a white color appearance by diffusely reflecting nearly all wavelengths of visible light incident on the first surface.

According to another embodiment, a metal part is described. The metal part includes a protective film disposed over an underlying metal surface of the metal part. The protective film includes a porous anodic film having a top surface corresponding to a top surface of the part. The porous anodic film includes a number of parallel-arranged pores having top ends adjacent to the top surface and bottom ends adjacent to an underlying metal surface of the part. At least a portion of the pores have metal oxide particles infused within them. The metal oxide particles provide a light scattering medium for diffusely reflecting nearly all visible wavelengths of light incident on the top surface and imparting a white appearance to the porous anodic film.

According to an additional embodiment, a method for forming a protecting layer on a part that reflects nearly all wavelengths of visible light incident on an exposed first surface is described. The protective layer includes a number of pores characterized as having a mean pore diameter and each having an opening at the first surface. The method includes driving a number of metal complex ions within at least a portion of the pores using an electrolytic process. During the electrolytic process, the underlying metal surface acts as an electrode that attracts the metal complex ions toward the metal substrate and to pore bottom ends opposite the openings of the pores. The method also involves allowing the metal complex ions to chemically react within the pores to form metal oxide particles. The metal oxide particles provide a light scattering medium for diffusely reflecting nearly all visible wavelengths of light incident on the top surface, thereby imparting a white appearance to the protective layer.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings.

DETAILED DESCRIPTION OF SELECTED EMBODIMENTS

Figure 1A:
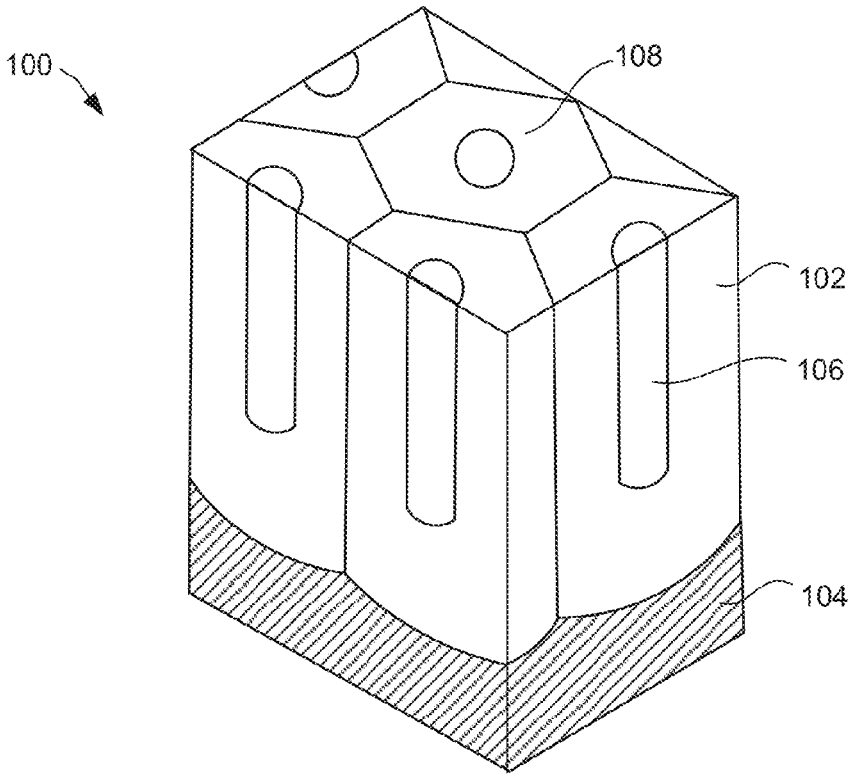
FIGS. 1A and 1B illustrate perspective and cross section views, respectively, of a portion of an anodized film formed using traditional anodizing techniques.

The following disclosure describes various embodiments of anodic films and methods for forming anodic films. Certain details are set forth in the following description and Figures to provide a thorough understanding of various embodiments of the present technology. Moreover, various features, structures, and/or characteristics of the present technology can be combined in other suitable structures and environments. In other instances, well-known structures, materials, operations, and/or systems are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

This application discusses anodic films that are white in appearance and methods for forming such anodic films. In general, white is the color of objects that diffusely reflect nearly all visible wavelengths of light. Methods described herein provide internal surfaces within the anodic film that can diffusely reflect substantially all wavelengths of visible light passing through an external surface of the anodic film, thereby imparting a white appearance to the anodic film. The anodic film can act as a protective layer in that it can provide corrosion resistance and surface hardness for the underlying substrate. The white anodic film is well suited for providing a protective and attractive surface to visible portions of a consumer product. For example, methods described herein can be used for providing protective and cosmetically appealing exterior portions of metal enclosures and casings for electronic devices.

One technique for forming white anodic films involves an optical approach where the porous microstructures of the films are modified to provide a light scattering medium. This technique involves forming branched or irregularly arranged pores within an anodic film. The system of branched pores can scatter or diffuse incident visible light coming from a top surface of the substrate, giving the anodic film white appearance as viewed from the top surface of the substrate.

Another technique involves a chemical approach where metal complexes are infused within the pores of an anodic film. The metal complexes, which are ionic forms of metal oxides, are provided in an electrolytic solution. When a voltage is applied to the electrolytic solution, the metal complexes can be drawn into pores of the anodic film. Once in the pores, the metal complexes can undergo chemical reactions to form metal oxides. In some embodiments, the metal oxides are white in color, thereby imparting a white appearance to the anodic film, which is observable from a top surface of the substrate.

As used herein, the terms anodic film, anodized film, anodic layer, anodized layer, oxide film, and oxide layer are used interchangeably and refer to any appropriate oxide film. The anodic films are formed on metal surfaces of a metal substrate. The metal substrate can include any of a number of suitable metals. In some embodiments, the metal substrate includes pure aluminum or aluminum alloy. In some embodiments, suitable aluminum alloys include 1000, 2000, 5000, 6000, and 7000 series aluminum alloys.

Figure 1B:
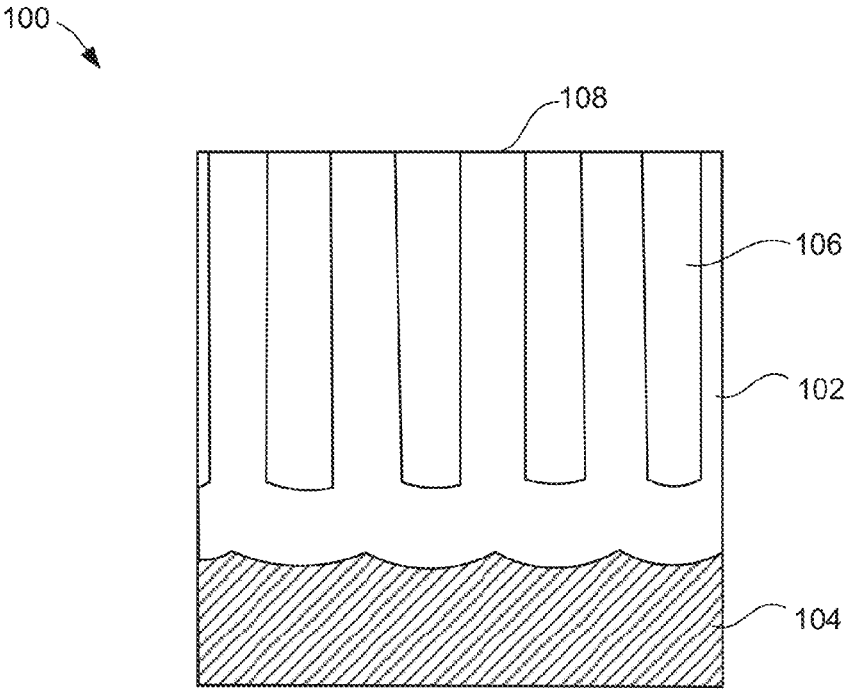

FIGS. 1A and 1B illustrate perspective and cross section views, respectively, of a portion of an anodized film formed using traditional anodizing techniques. FIGS. 1A and 1B show part 100 having anodic film 102 disposed over metal substrate 104. In general, anodic films are grown on a metal substrate by converting a top portion of the metal substrate to an oxide. Thus, an anodic film becomes an integral part of the metal surface. As shown, anodic film 102 has a number of pores 106, which are elongated openings that are formed substantially perpendicularly in relation to a surface of substrate 104. Pores 106 are uniformly formed throughout anodic film 102 and are parallel with respect to each other and perpendicular with respect to top surface 108 and metal substrate 104. Each of pores 106 have an open end at top surface 108 of anodic film 102 and a closed end proximate to metal substrate 104. Anodic film 102 generally has a translucent characteristic. That is, a substantial portion of visible light incident top surface 108 can penetrate anodic film 102 and reflect off of metal substrate 104. As a result, a metal part having anodic film 102 would generally have a slightly muted metallic look to it.

Forming Branched Pore Structures

One method for providing a white anodic film on a substrate involves forming a branched pore structure within the anodic film. FIGS. 2A-2E illustrate cross section views of a surface of a metal part 200 undergoing an anodizing process for providing an anodic film with branched pores. At FIG. 2A, a top portion of substrate 202 is converted to barrier layer 206. As such, the top surface of barrier layer 206 corresponds to top surface 204 of part 200. Barrier layer 206 is generally a thin, relatively dense, barrier oxide of uniform thickness that is non-porous layer in that there are substantially no pores, such as pores 106 of part 100. In some embodiments, forming barrier layer 206 can involve anodizing part 200 in an electrolytic bath containing a neutral to weakly alkaline solution. In one embodiment, a weakly alkaline bath that includes monoethanolamine and sulfuric acid is used. In some embodiments, barrier layer 206 has indented portions 208 at a top surface 204. Indented portions 208 are generally broad and shallow in shape compared to pores of typical porous anodic films. Barrier layer 206 is typically grown to a thickness of less than about 1 micron.

Figure 2A:
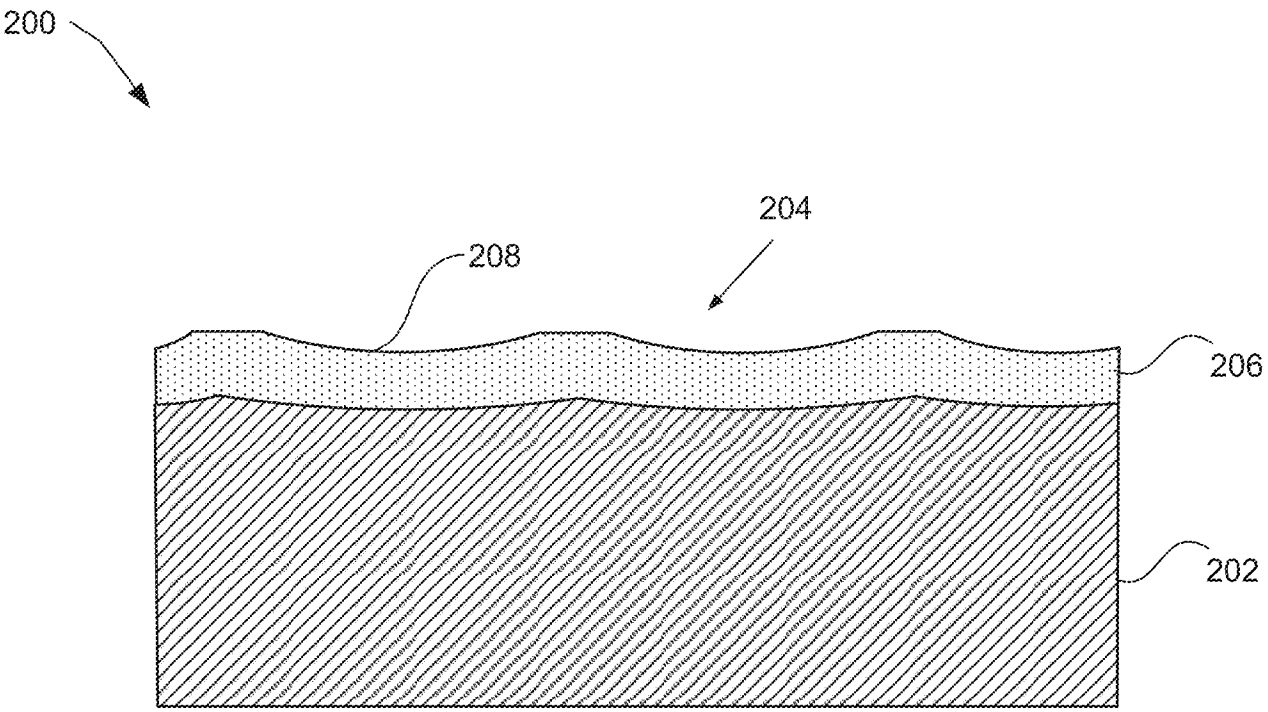
FIGS. 2A-2E illustrate cross section views of a metal substrate undergoing an anodizing process for providing an anodized film with branched pores.
Figure 2B:
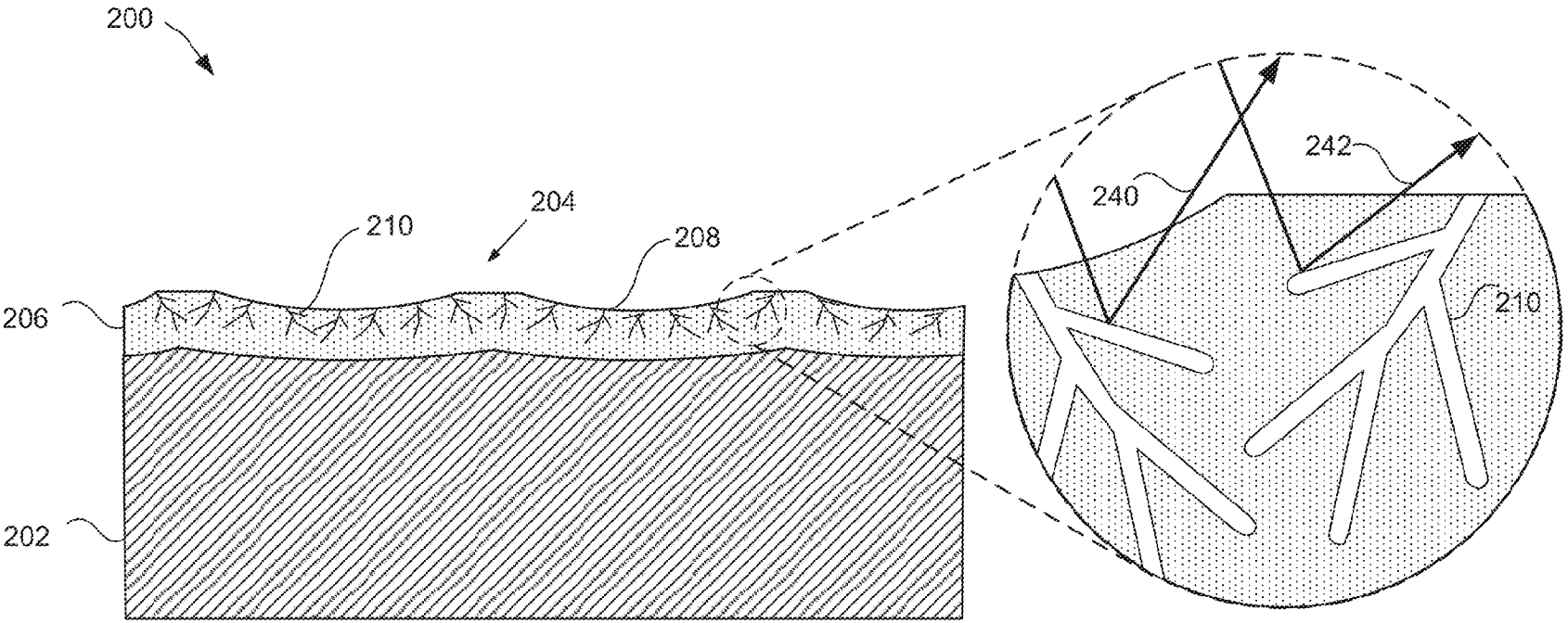

At FIG. 2B, branched structures 210 are formed within barrier layer 206. In some embodiments, indented portions 208 can facilitate the formation of branched structures 210. Branched structures 210 can be formed within barrier layer 206 by exposing part 200 to an electrolytic process using a weakly acid bath, similar to an anodizing process. In some embodiments, a constant voltage is applied during the formation of branched structures 210. Table 1 provides electrolytic process condition ranges appropriate for forming branched structures 210 within barrier layer 206.

TABLE 1

| Parameter | Value range |
|---|---|
| Bath temperature | 16 C.-24 C. |
| Voltage (DC) | 5 V-30 V |
| Current Density | 0.2-3.0 A/dm$^2$ |
| Duration | ≤60 minutes |

Since barrier layer 206 is generally non-conductive and dense, the electrolytic process forming branched structures 210 within barrier layer 206 is generally slow compared to forming pores using a typical anodizing process. The current density value during this process is generally low since the electrolytic process is slow. Instead of long parallel pores, such as pores 106 of FIGS. 1A and 1B, branched structures 210 grow down in a branching pattern commensurate with the slow branched structure 210 formation. Branched structures 210 are generally non-parallel with respect to each other and are generally shorter in length compared to typical anodic pores. As shown, branched structures 210 are arranged in irregular and non-parallel orientations with respect to surface 204. Thus, light entering from top surface 204 can scatter or be diffusely reflected off of the walls of branched structures 210. To illustrate, light ray 240 can enter from top surface 204 and reflect off a portion of branched structures 210 at a first angle. Light ray 242 can enter top surface 204 and reflect off a different portion of branched structures 210 at a second angle different from the first angle. In this way, the assembly of branched structures 210 within barrier layer 206 can act as a light scattering medium for diffusing incident visible light entering from top surface 204, giving barrier layer 206 and part 200 an opaque and white appearance. The amount of opacity of barrier layer 206 will depend upon the amount of light that is reflecting off of the walls of branched structures 210 rather than penetrating through barrier layer 206.

Figure 2C:
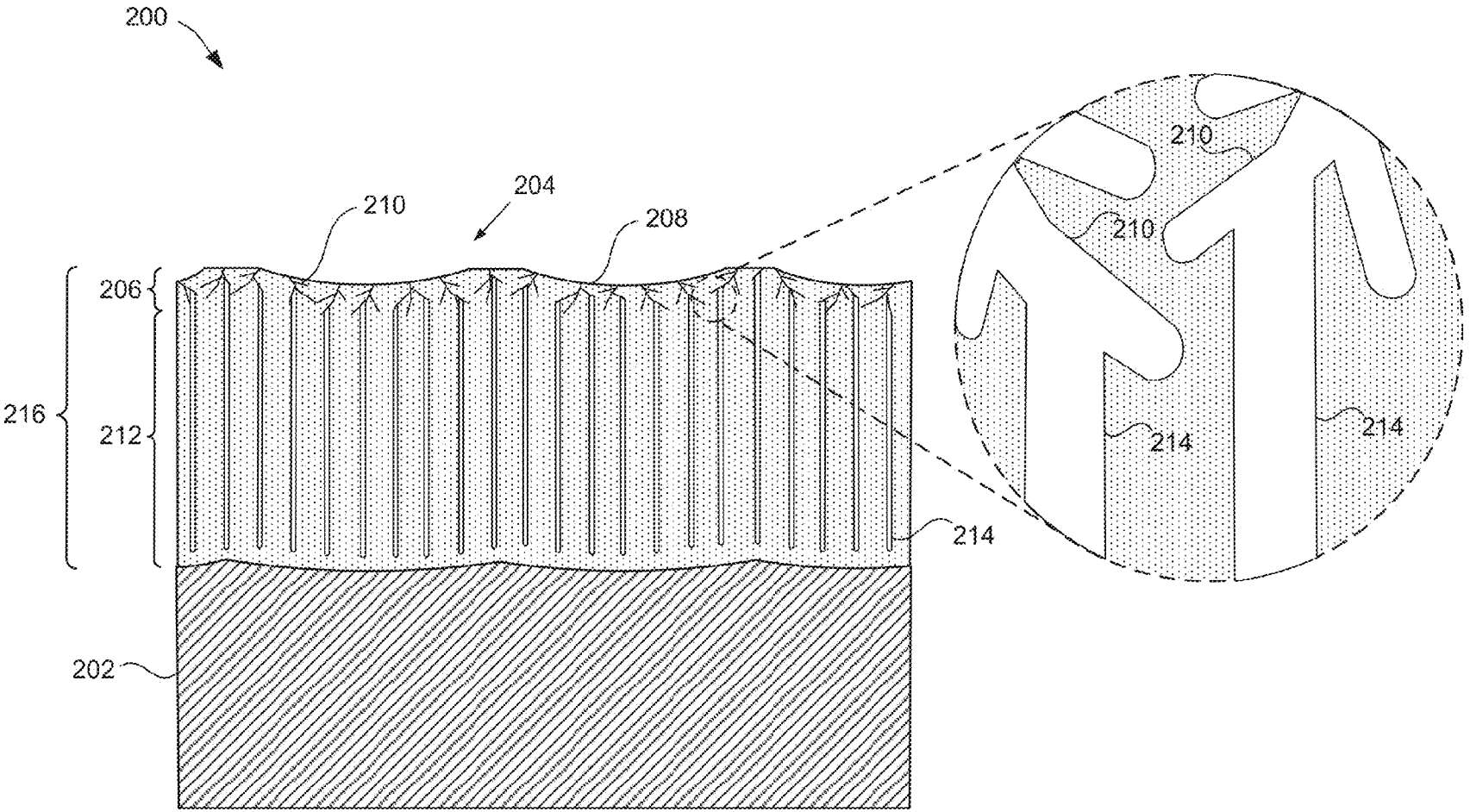

When branched structures 210 have completed formation through the thickness of barrier layer 206, the current density reaches what can be referred to as a recovery current value. At that point, the current density rises and the electrolytic process continues to convert metal substrate 202 to a porous anodic oxide. FIG. 2C shows a portion of metal substrate 202, below barrier layer 206, converted to porous anodic layer 212. Pores 214 begin formation as soon as the current recovery value is attained and proceed to form and convert a portion of metal substrate 202 until a desired thickness is achieved. In some embodiments, the time in which it takes to reach the current recovery value is between about 10 to 25 minutes. In some embodiments, after the current recovery value is reached, a constant current density anodizing process is used. As porous anodic layer 212 continues to build up, the voltage can be increased to retain the constant current density. Porous anodic layer 212 is generally grown to a greater thickness than barrier layer 206 and can provide structural support to barrier layer 206. In some embodiments, porous anodic layer 212 is grown to between about 5 microns and 30 microns in thickness.

Pores 214 actually continue or branch out from branched structures 210. That is, the acidic electrolytic solution can travel through to the bottoms of branched structures 210 where pores 214 begin to form. As shown, pores 214 are formed in substantially parallel orientation with respect to each other and are substantially perpendicular with respect to top surface 204, much like standard anodizing processes. Pores 214 have top ends that continue from branched structures 210 and bottom ends adjacent to the surface of underlying metal substrate 202. After porous anodic layer 212 is formed, substrate 202 has protective layer 216 that includes a system of branched structures 210, imparting an opaque and white quality to part 200, and supporting porous anodic layer 212.

Figure 2D:
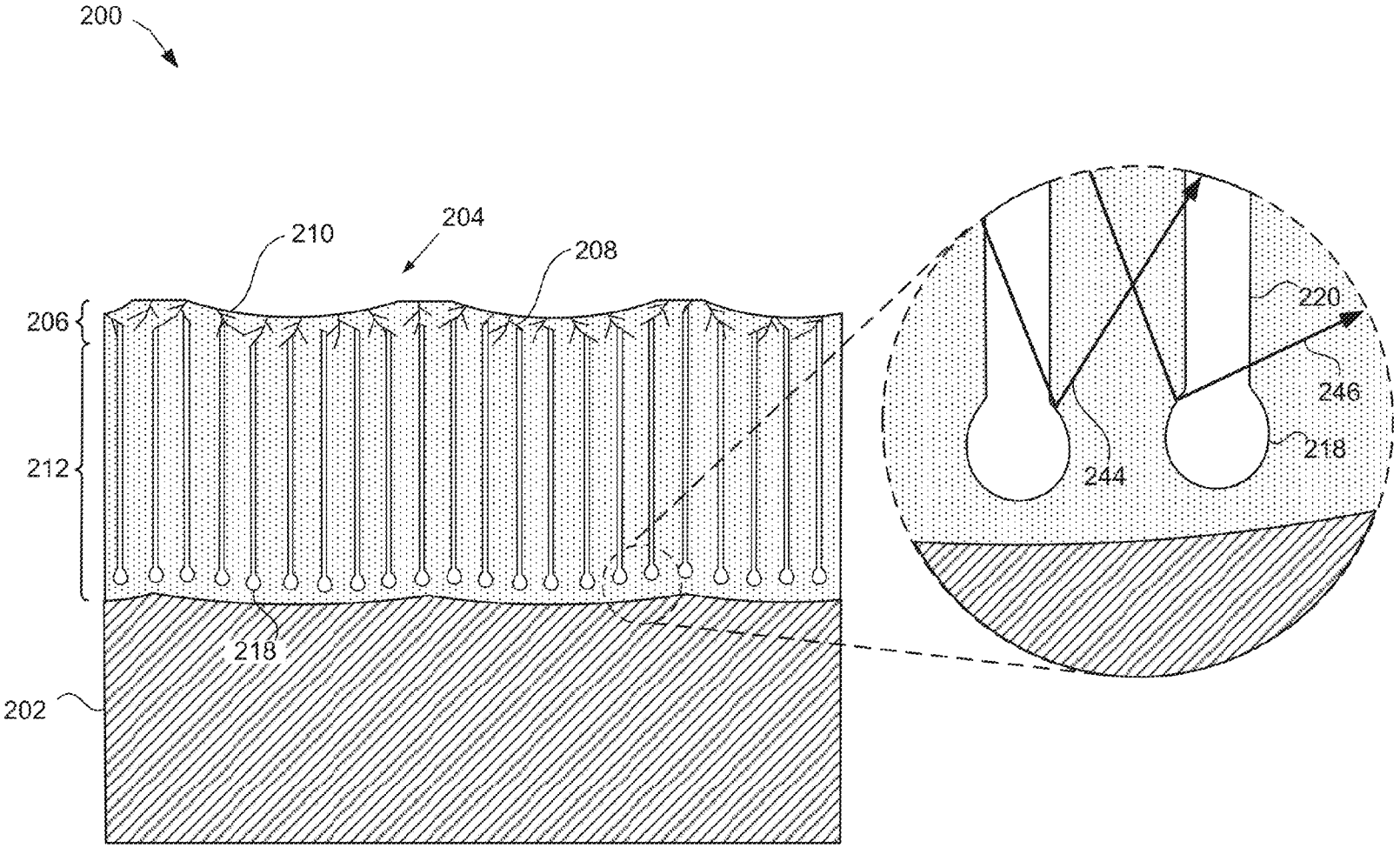

In some embodiments, an opaque and white quality can also be imparted to porous anodic layer 212. FIG. 2D shows part 200 after porous anodic layer 212 has been treated to have an opaque and white appearance. The opaque and white appearance can be achieved by exposing part 200 to an electrolytic process having an acidic bath with a relatively weak voltage. In some embodiments, the electrolytic bath solution contains phosphoric acid. Table 2 provides anodizing process condition ranges appropriate for forming bulbous-shaped bottom portions 218.

TABLE 2

| Parameter | Value range |
|---|---|
| Bath temperature | 12 C.-30 C. |
| Voltage (DC) | 2 V-25 V |
| Duration | 0.5 min-16 min |

As shown, the shapes of bottom portions 218 of pores 214 have been modified to have bulbous shapes. The average width of bulbous-shaped bottom portions 218 is wider than the average width of remaining portions 220 of pores 214. Bulbous-shaped bottom portions 218 have rounded sidewalls that extend outward with respect to remaining portions 220 of pores 214. Light ray 244 can enter from top surface 204 and reflect off a portion of bulbous-shaped bottom portions 218 at a first angle. Light ray 246 can enter top surface 204 and reflect off a different portion of bulbous-shaped bottom portions 218 at a second angle different from the first angle. In this way, the assembly of bulbous-shaped bottom portions 218 within porous anodic layer 212 can act as a light scattering medium for diffusing incident visible light entering from top surface 204, adding an opaque and white appearance to porous anodic layer 212 and part 200. The amount of opacity of porous anodic layer 212 can depend upon the amount of light that is reflecting off of bulbous-shaped bottom portions 218 rather than penetrating through porous anodic layer 212.

Figure 2E:
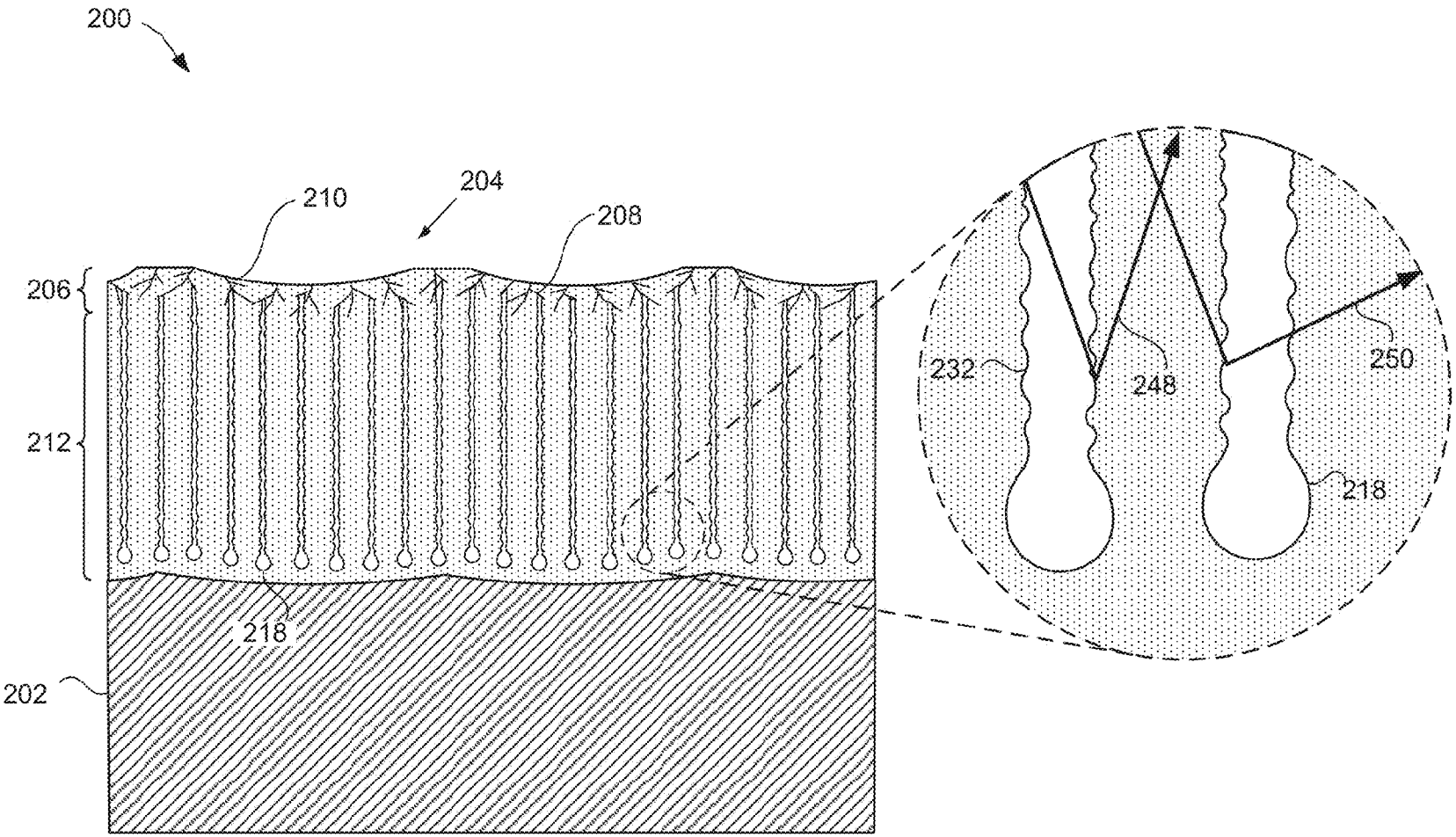

In some embodiments, additional treatments can be applied to porous anodic layer 212. FIG. 2E shows part 200 after porous anodic layer 212 has undergone an additional treatment. As shown, walls 232 of pores 214 are roughened to have bumpy or irregular shapes. In some embodiments, the process for producing irregular pore walls 232 can also involve widening pores 214. Formation of irregular pore walls 232 can be accomplished by exposing part 200 to a weakly alkaline solution. In some embodiments, the solution includes a metal salt. Table 3 provides typical solution condition ranges appropriate for roughening pore walls 232.

TABLE 3

| Parameter | Value range |
|---|---|
| Bath temperature | 30 C.-100 C. |
| pH | 1-3 |
| Duration | 2 sec-2 min |

Portions of irregularly shaped pore walls 232 extend outward with respect to remaining portions 220 of pores 214, creating a surface that incoming light can scatter off of. Light ray 248 can enter from top surface 204 and reflect off irregularly shaped pore walls 232 at a first angle. Light ray 250 can enter top surface 204 and reflect off a different portion of irregularly shaped pore walls 232 at a second angle different from the first angle. In this way, the assembly of irregularly shaped pore walls 232 within porous anodic layer 212 can act as a light scattering medium for diffusing incident visible light entering from top surface 204, thereby adding to the opaque and white appearance of porous anodic layer 212 and part 200.

Figure 3:
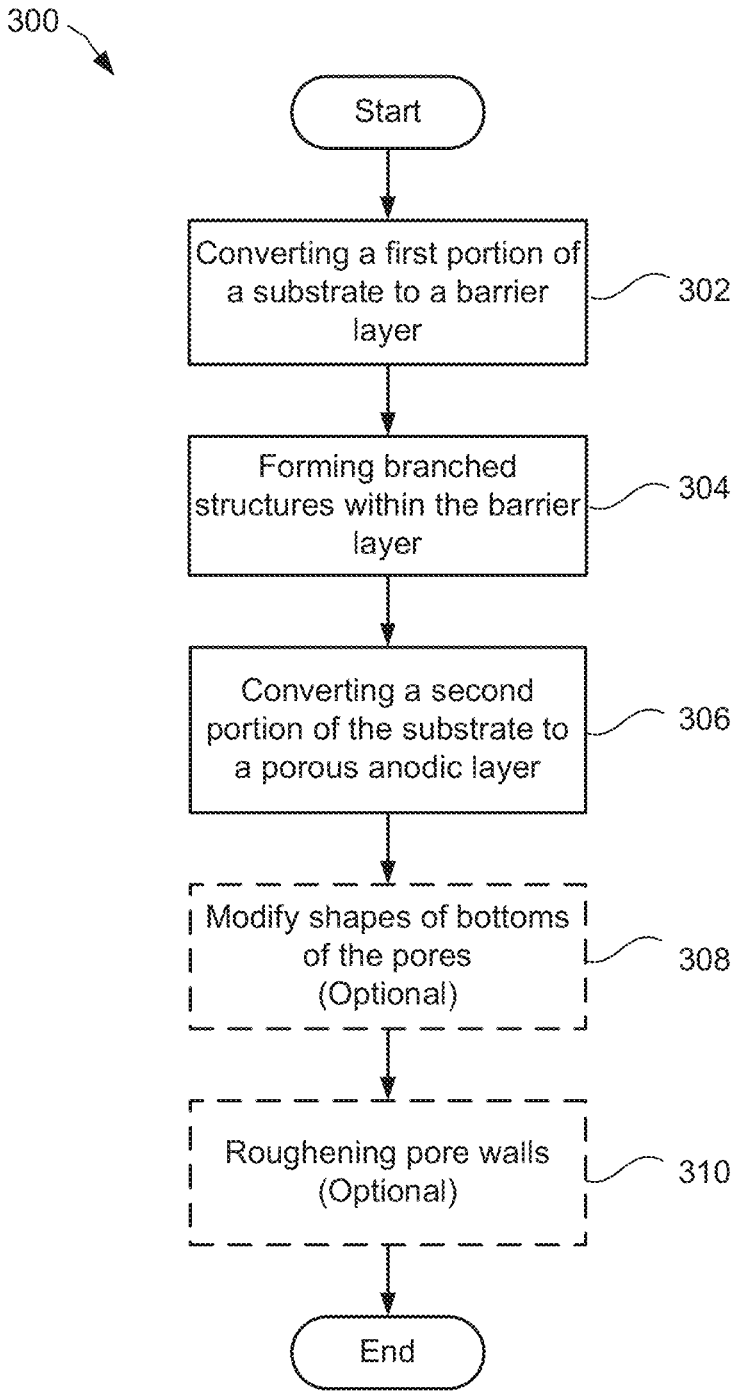
FIG. 3 illustrates a flowchart indicating an anodizing process for providing an anodized film with branched pores.

FIG. 3 shows flowchart 300 indicating an anodizing process for forming an anodized film with a branched pore system on a substrate, in accordance with described embodiment. Prior to the anodizing process of flowchart 300, the surface of the substrate can be finished using, for example, a polishing or texturing process. In some embodiments, the substrate undergoes one or more pre-anodizing processes to clean the surface. At 302, a first portion of the substrate is converted to a barrier layer. In some embodiments, the barrier layer has a top surface that has indented portions that are broad and shallow compared to anodic pores. These indented portions can facilitate the formation of branched structures. At 304, branched structures are formed within the barrier layer. The branched structures can be formed by exposing the substrate to an acidic electrolytic bath at lower voltages or current densities compared to a typical anodizing process. The branched structures are elongated in shape and grow in a branching pattern commensurate with a reduced voltage or current density applied during the anodizing process. The branched or irregular arrangement of the branched structures can diffuse incident visible light, giving the barrier layer an opaque and white appearance. At 306, a second portion of the substrate, below the barrier layer, is converted to a porous anodic layer. The porous anodic layer can add structural support to the barrier layer. The porous anodic layer can be formed by continuing the anodizing process for forming the branched structures until the electrical current reaches a recovery current value, then continuing the anodizing process until a target anodic layer thickness is achieved. After processes 302, 304 and 306, the resultant anodic film can have an opaque and white appearance that can be sufficiently thick to provide protection for underlying substrate.

At 308, the shapes of the bottoms of the pores are optionally modified to have a bulbous shape. The bulbous shape of the pore bottoms within the porous anodic layer can act as a second light scattering medium for adding an opaque and white quality to the substrate. At 310, the pores are optionally widened and the pore walls are optionally roughened. The roughened irregularly shaped walls can increases the amount of light scattered from the porous anodic layer and add to the white color and opacity of the substrate.

Infusing Metal Complexes

Another method for providing a white anodic film on a substrate involves infusing metal complexes within the pores of an anodic film. Standard dyes that are white in color are generally not able to fit within the pores of an anodic film. For example, some white dyes contain titanium dioxide ($TiO_2$) particles. Titanium dioxide generally forms in particles that have a diameter on the scale of 2 to 3 microns. However, the pores of typical aluminum oxide films typically have diameters on the scale of 10 to 20 nanometers. Methods described herein involve infusing metal complexes into the pores of anodic films, where they undergo chemical reactions to form metal oxide particles once lodged within the pores. In this way, metal oxide particles can be formed within anodic pores that would not otherwise be able to fit within the anodic pores.

FIGS. 4A-4E illustrate cross section views of a surface of a metal substrate undergoing an anodizing process for providing an anodic film using infused metal complexes. At FIG. 4A, a portion, including top surface 404, is converted to a porous anodic layer 412. As such, the top surface of porous anodic layer 412 corresponds to top surface 404 of part 400. Porous anodic layer 412 has pores 414 that are elongated in shape and that are substantially parallel with respect to each other and substantially perpendicular with respect to top surface 404. Pores 414 have a top ends at top surface 404 and bottom ends adjacent to the surface of underlying metal 402. Any suitable anodizing conditions for forming porous anodic layer 212 can be used. Porous anodic layer 412 is generally translucent in appearance. As such, the surface of underlying metal 402 can be partially visible through porous anodic layer 412, giving part 400, as viewed from top surface 404, a muted metallic color and appearance. In some embodiments, anodic layer 412 is grown to between about 5 microns and 30 microns in thickness.

Figure 4A:
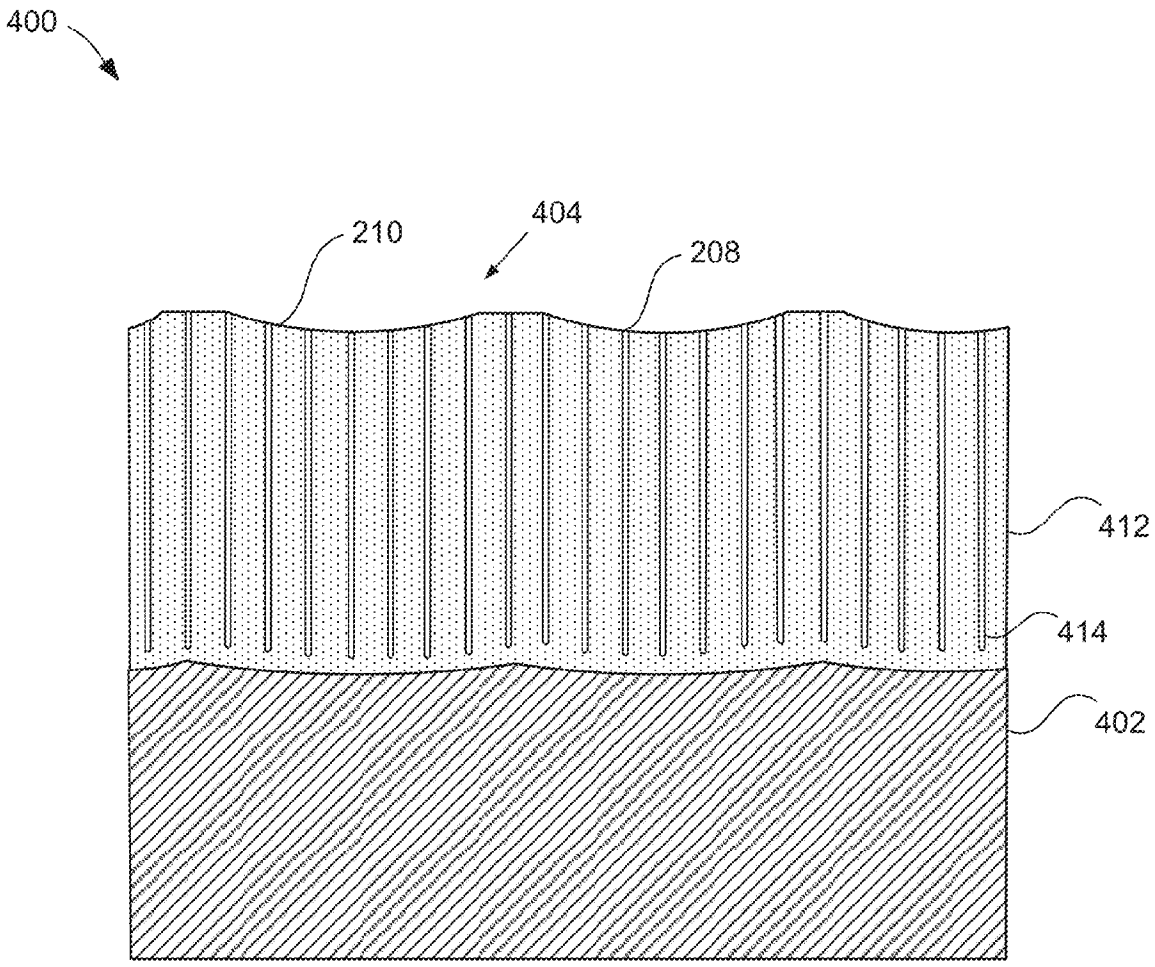
FIGS. 4A-4E illustrate cross section views of a metal substrate undergoing an anodizing process for providing an anodized film with infused metal oxide particles.
Figure 4B:
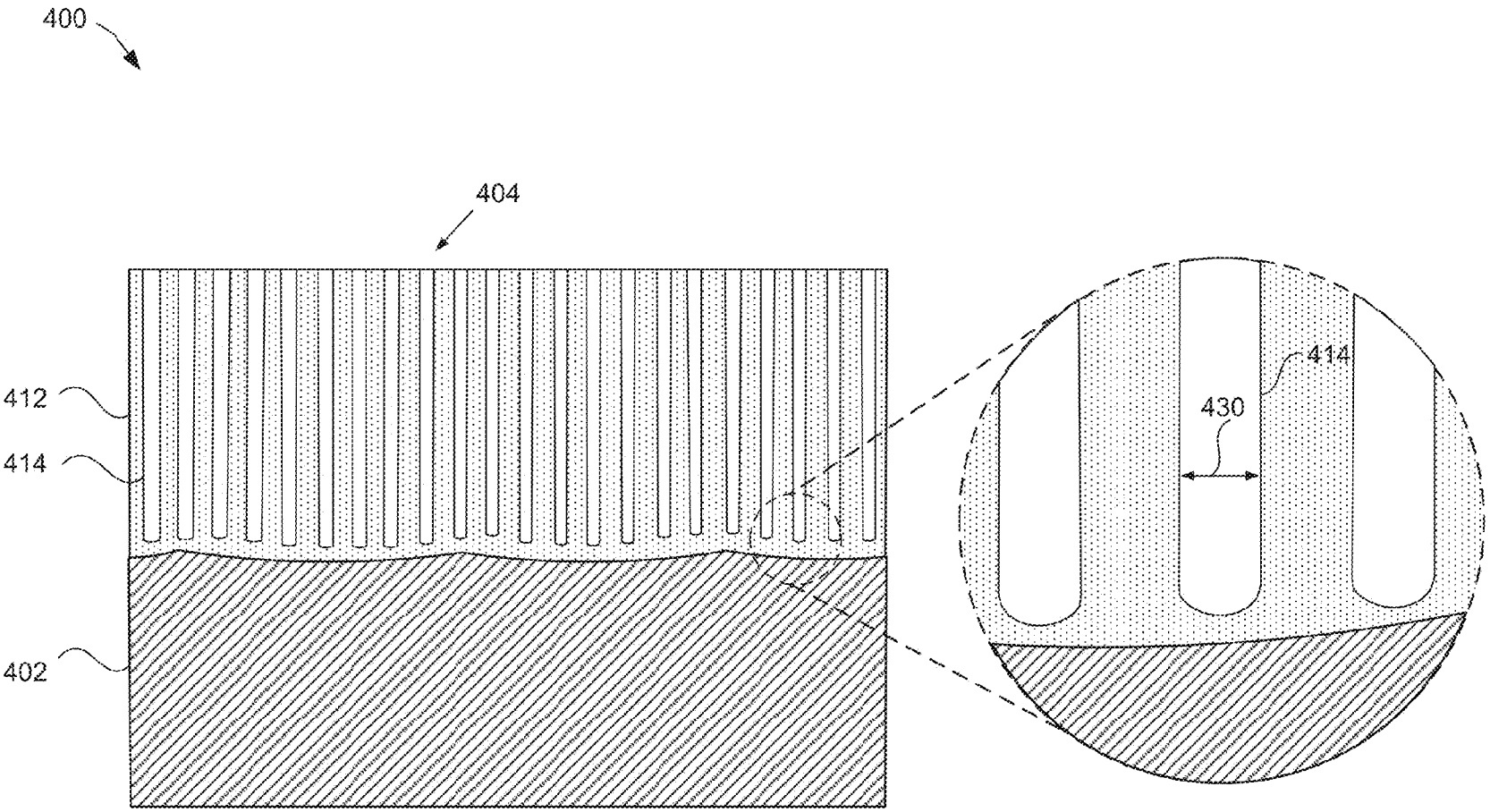

At FIG. 4B, pores 414 of anodic layer 412 are optionally widened to an average diameter 430 that is wider than the average diameter of pores 414 before widening. Pores 414 can be widened to accommodate the infusion of a metal complex in a subsequent procedure. The amount of widening of pores 414 can depend on particular application requirements. In general, the wider pores 414 allow more space for metal complex to be infused therein. In one embodiment, widening of pores 414 is achieved by exposing part 400 to an electrolytic process having an acidic bath with a relatively weak voltage. In some embodiments, the solution includes a metal salt. In some cases, the widening process also roughens the walls of pores 414 and/or modified the bottom portions of pores 414.

Figure 4C:
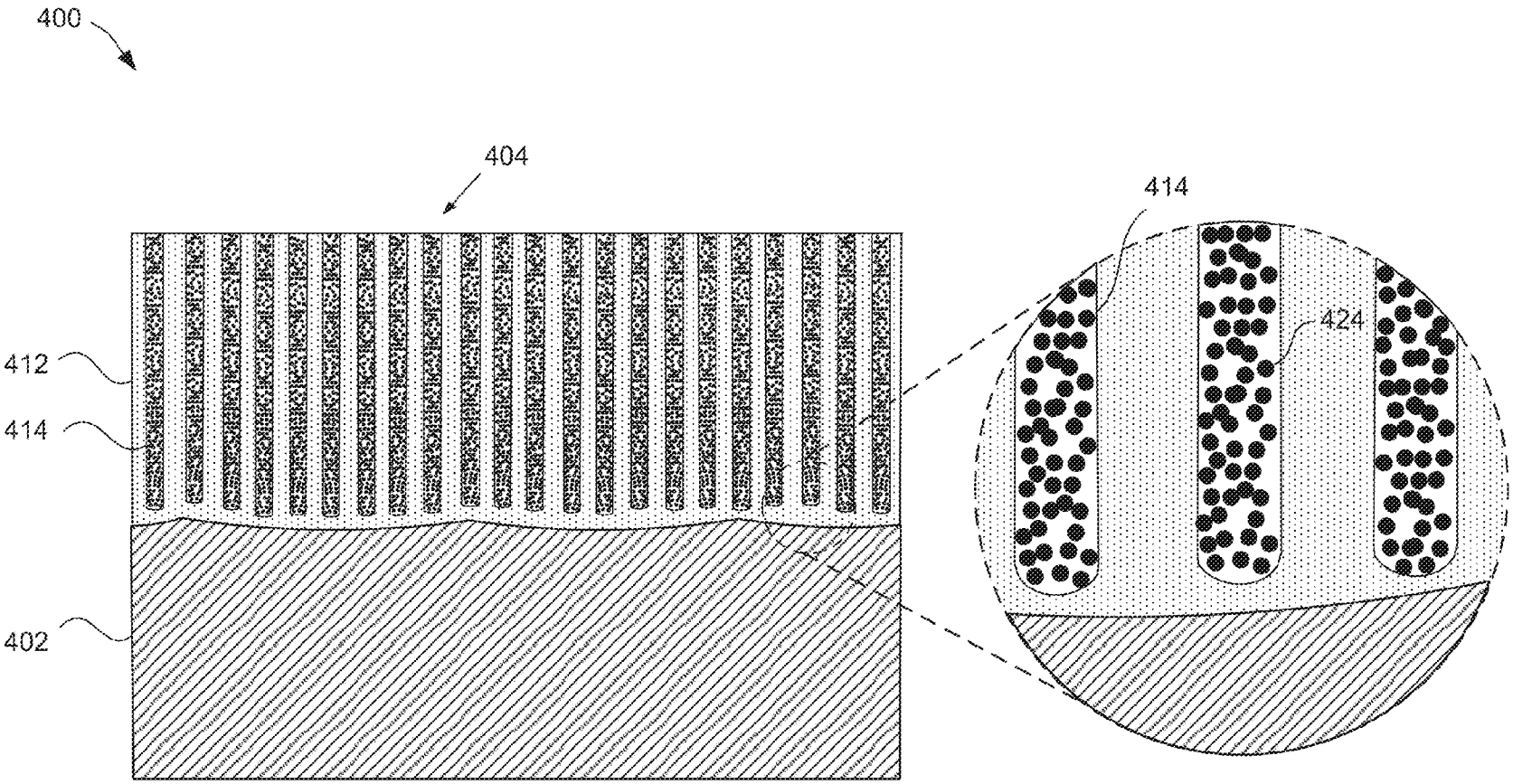

At FIG. 4C, pores 414 are infused with metal complexes 424, which are metal-containing compounds. In some embodiments, metal complexes 424 are metal oxide compounds in ionic form. Metal complexes 424 have an average diameter that is smaller than the average pore size of a typical aluminum oxide film, with or without a pore widening process. Therefore, metal complexes 424 can readily fit within pores 414 of anodic layer 412. In addition, in embodiments where metal complexes 424 are in anionic from, metal complexes 424 are attracted toward the substrate 402 electrode and driven into the bottoms of pores 414 when a voltage is applied to the solution in an electrolytic process. In some embodiments, metal complexes 424 are added until pores 414 are substantially filled with metal complexes 424, as shown in FIG. 4C. In one embodiment, metal complexes 424 include titanium oxide anions. The titanium oxide anions can be formed by providing titanium oxysulfate ($TiOSO_4$) and oxalic acid ($C_2H_2O_4$) in an aqueous electrolytic solution. In solution, titanium oxysulfate forms a titanium oxide (IV) complex ($[TiO(C_2O_4)_2]^{2-}$). In one embodiment, the titanium oxide (IV) anions are formed by providing $Ti(OH)_2[OCH(CH_3)COOH]_2+C_3H_8O$ in an aqueous electrolytic solution. Table 4 provides typical electrolytic process condition ranges appropriate for infusing pores 414 with titanium oxide metal complexes.

TABLE 4

| Parameter | Value range |
|---|---|
| Bath temperature | 10 C.-80 C. |
| pH | 1-7 |
| Duration | 30 sec-60 min |
| Voltage | ≥2 V |

Figure 4D:
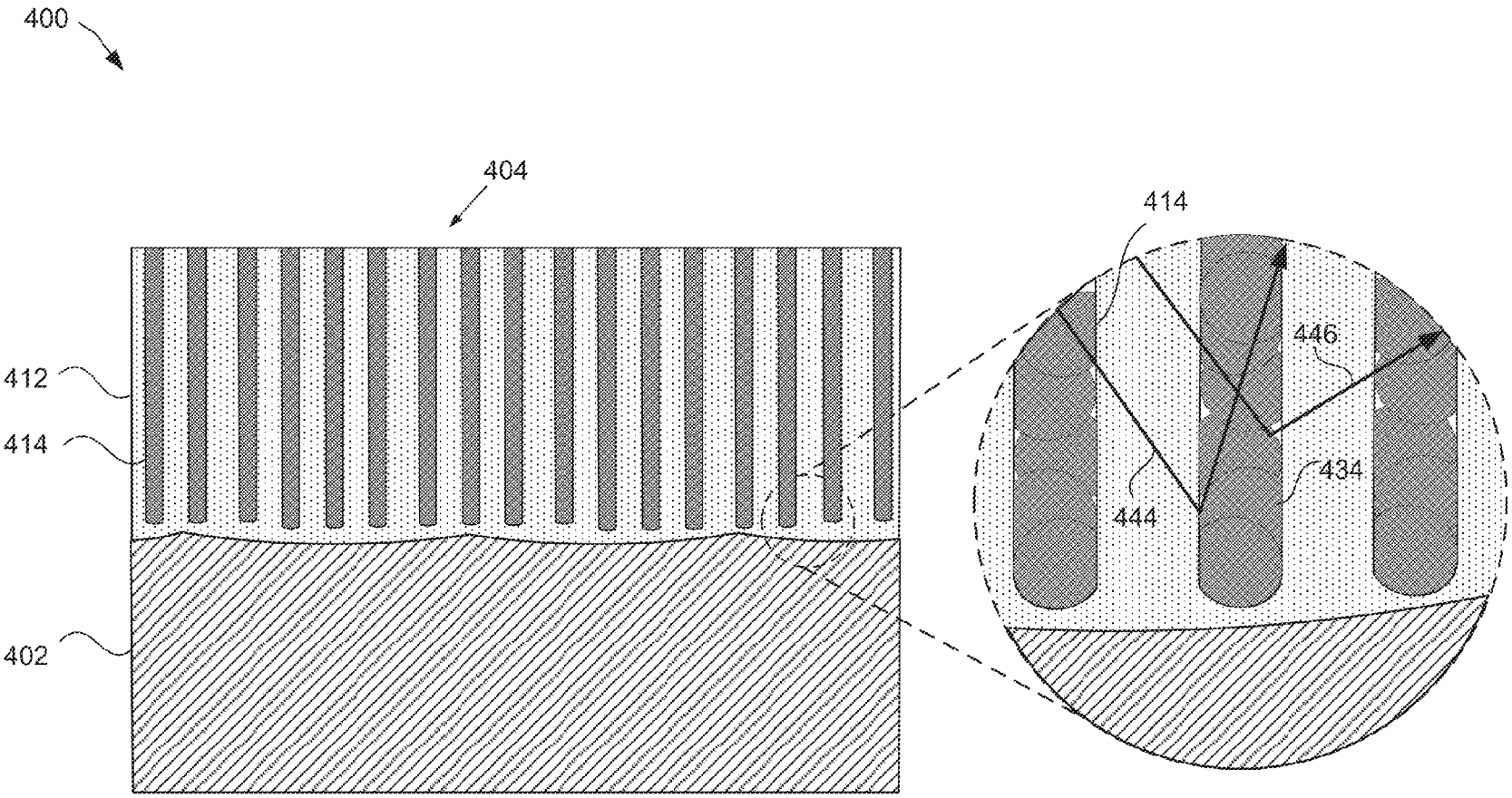

At FIG. 4D, once inside pores 414, metal oxide complexes 424 can undergo a chemical reaction to form metal oxide compound 434. For example, titanium oxide complex ($[TiO(C_2O_4)_2]^{2-}$) can undergo the following reaction within pores 414.

$$[TiO(C_2O_4)_2]^{2-}+2OH^- \rightarrow TiO_2.H_2O+2C_2O_4^{2-}$$

Thus, once inside pores 414, the titanium oxide (IV) complex can be converted to a titanium oxide compound. Once inside pores 414, particles 434 of the metal oxide compound generally have a size larger than metal complexes 424 and are thereby entrapped within pores 414. In some embodiments, metal oxide particles 434 conform to a shape and size in accordance with pores 414. In embodiments described herein, metal oxide particles 434 are generally white in color in that they substantially diffusely reflect all visible wavelengths of light. For example, light ray 444 can enter from top surface 404 and reflect off a portion of metal oxide particles 434 at a first angle. Light ray 446 can enter top surface 404 and reflect off a different portion of metal oxide particles 434 at a second angle different from the first angle. In this way, the metal oxide particles 434 within porous anodic layer 412 can act as a light scattering medium for diffusing incident visible light entering from top surface 404, giving porous anodic layer 412 and part 400 an opaque and white appearance. The whiteness of porous anodic layer 412 can be controlled by adjusting the amount of metal complexes 424 that are infused within pores 414 and converted to metal oxide particles 434. In general, the more metal oxide particles 434 within pores 414, the more saturated white porous anodic layer 412 and part 400 will appear.

Figure 4E:
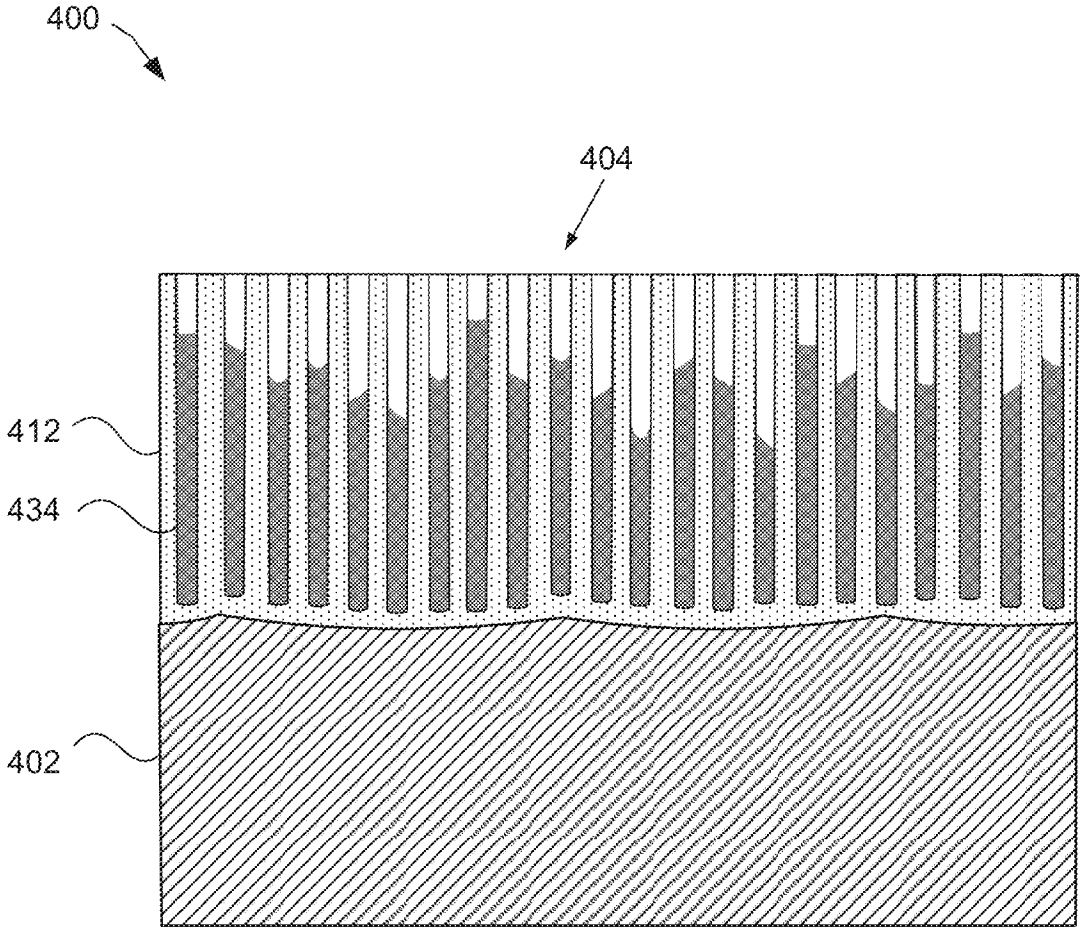

At FIG. 4E, pores 414 are optionally sealed using a sealing process. Sealing closes pores 414 such that pores 414 can assist in retaining metal oxide particles 434. The sealing process can swell the pore walls of porous anodic layer 412 and close the top ends of pores 414. Any suitable sealing process can be used. In one embodiment, the sealing process includes exposing part 400 to a solution containing hot water with nickel acetate. In some embodiments, the sealing process forces some of metal oxide particles 434 to be displaced from top portions of pores 414. As shown, in FIG. 4D, portions of metal oxide particles 434 at top portions of pores 414 have been displaced during the sealing process. In some embodiments, metal oxide particles 434 resides within the bottom portions of pores 414. Thus, portions of metal oxide particles 434 still remain within the pores even after the sealing process.

Figure 5:
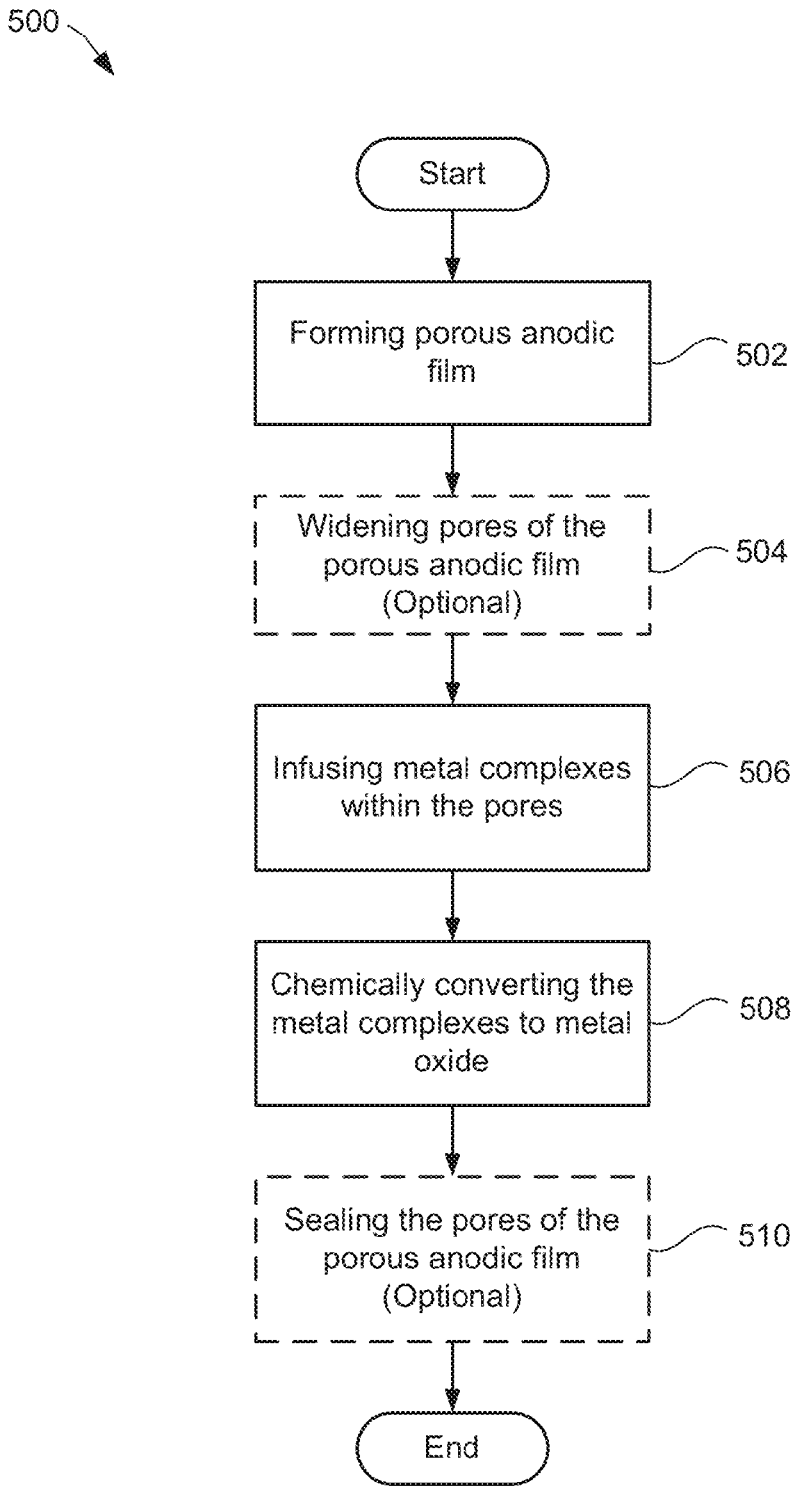
FIG. 5 illustrates a flowchart describing an anodizing process for providing an anodized film with infused metal complexes.

FIG. 5 shows flowchart 500 indicating an anodizing process for forming an anodized film with infused metal oxide particles, in accordance with described embodiment. Prior to the anodizing process of flowchart 500, the surface of a substrate can be finished using, for example, a polishing or texturing process. In some embodiments, the substrate undergoes one or more pre-anodizing processes to clean the surface. At 502, a porous anodic film is formed in the substrate. The porous anodic film has elongated pores formed in parallel orientation with respect to each other. At this point, the porous anodic film generally has a translucent appearance. At 504, the pores are optionally widened to accommodate more metal complexes in subsequent procedure 506. At 506, the pores are infused with metal complexes. An electrolytic process can be used to drive the anionic metal complexes towards the substrate electrode and into the bottoms of the pores. Once within the pores, at 508 the metal complexes can undergo a chemical reaction to form metal oxide particles that impart an opaque and white appearance to the porous anodic film and the substrate. In one embodiment, the metal oxide particles include titanium oxide, which has a white appearance. At 510, the pores of the porous anodic film are optionally sealed using a sealing process. The sealing process retains the metal oxide particles within the pores after the anodizing and whitening processes.

Figure 6A:
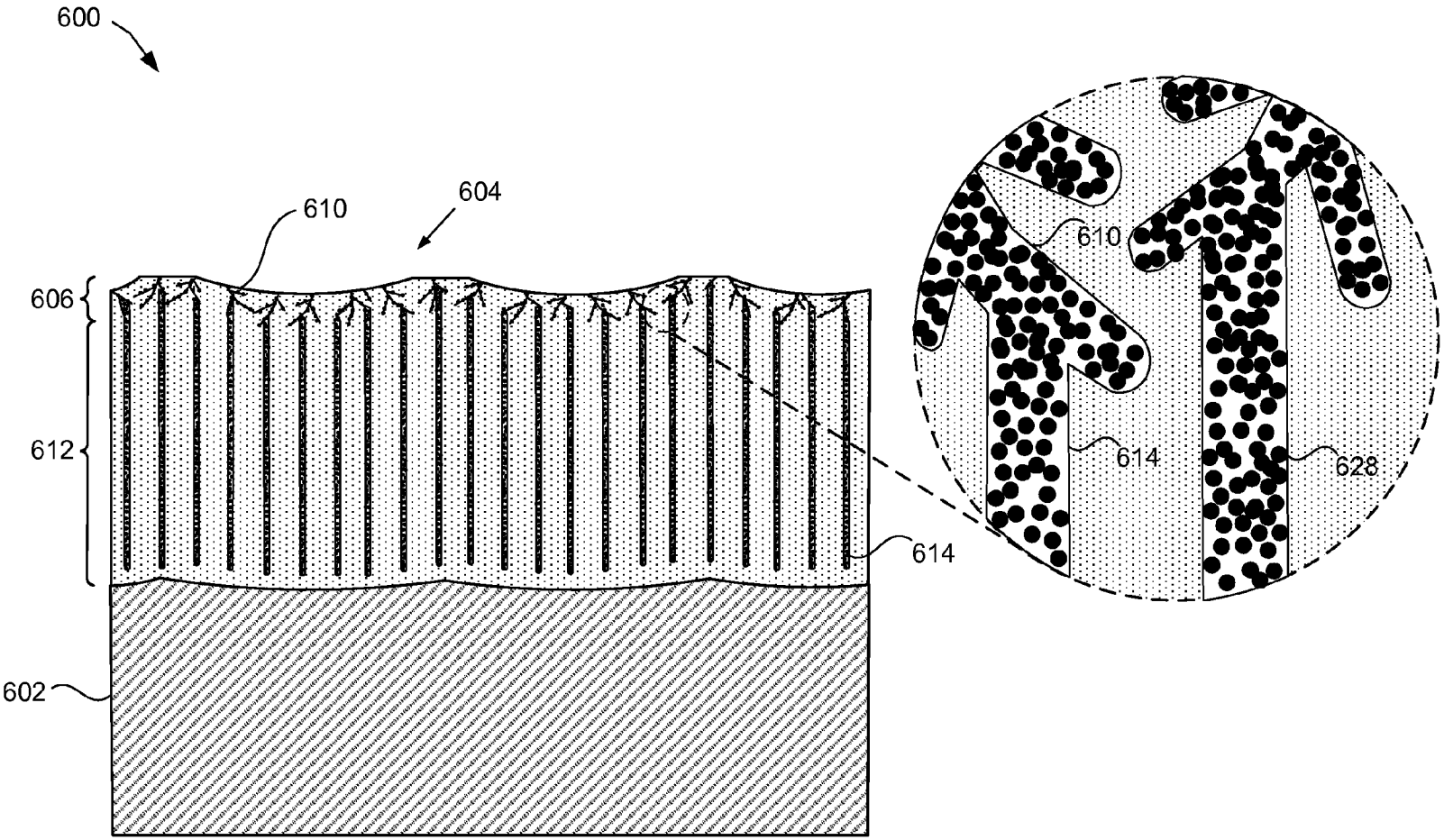
FIGS. 6A and 6B illustrate a cross section view of a metal substrate undergoing an anodizing process for providing an anodized film with branched pore structure having infused metal oxide particles.
Figure 6B:
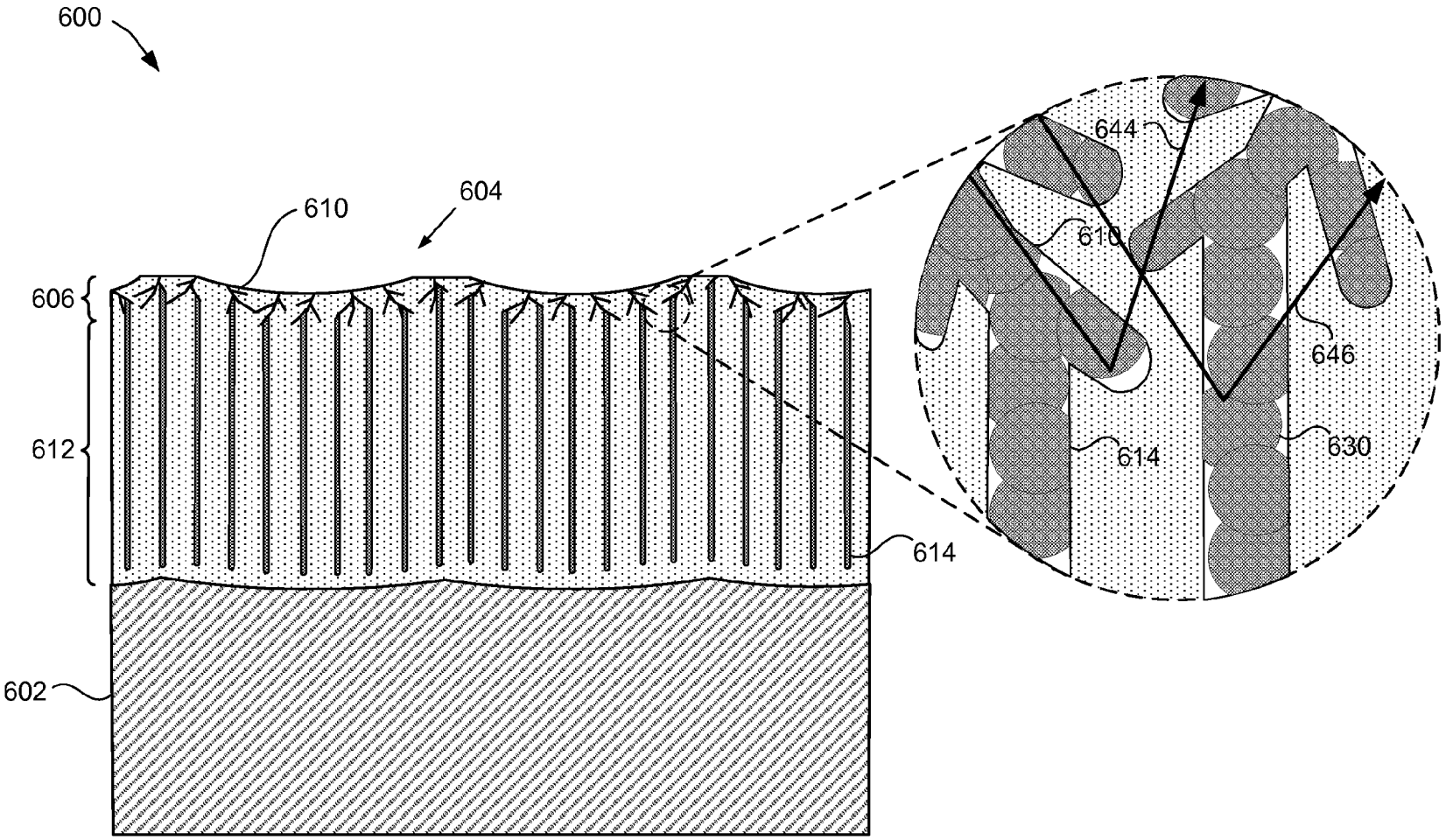
Figure 7:
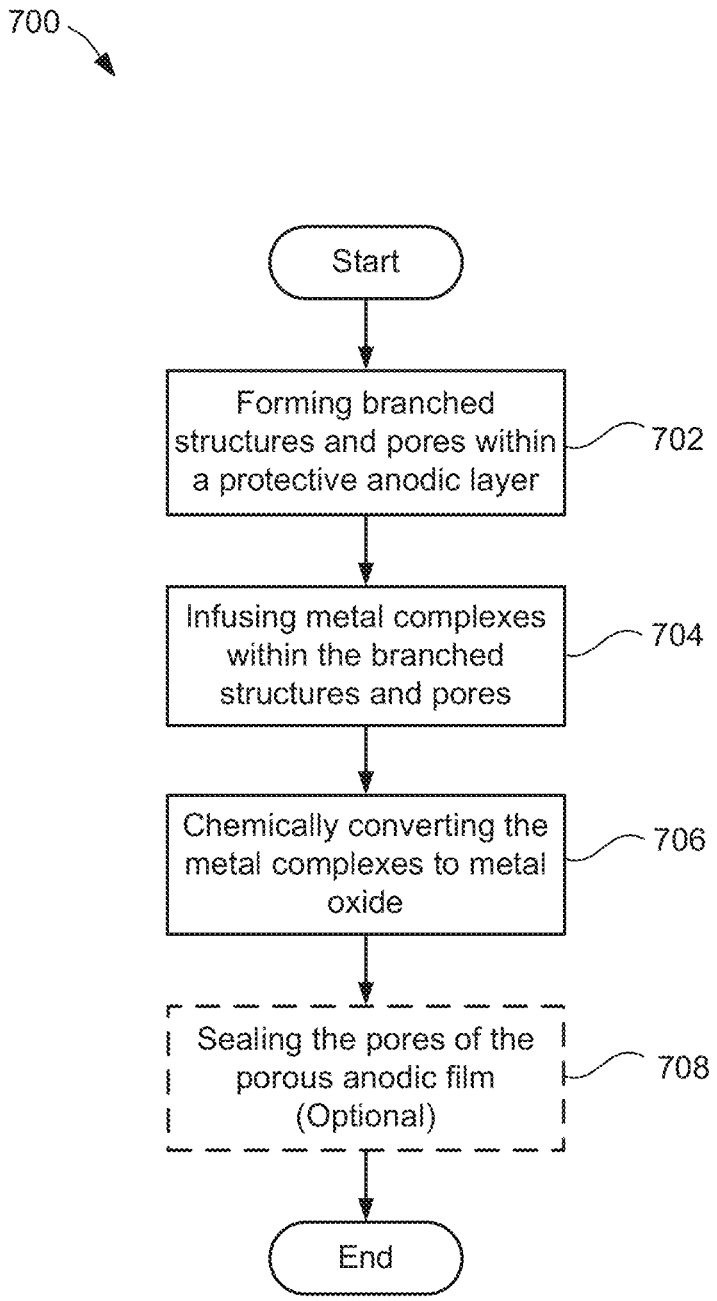
FIG. 7 illustrates a flowchart indicating an anodizing process for providing an anodized film with branched pores and with infused metal complexes.

In some embodiments, the aspects of the methods of forming branched pores structures and the methods of infusing metal complexes described above can be combined. FIG. 6A shows part 600 with barrier layer 606 and porous anodic layer 612 formed over substrate 602. Barrier layer 606 has branched structures 610 that are continuous with pores 614 within porous anodic layer 612. As shown, metal complexes 628 are infused within branched structures 610 and pores 614, similar to the metal complexes of FIG. 4C. At FIG. 6B, metal complexes 628 have been chemically altered to form metal oxide particles 630, similar to the metal oxide particles of FIG. 4D. Metal oxide particles 630 generally conform to a shape and size in accordance with branched structures 610 and pores 614. Metal oxide particles 630 are generally white in color since they can diffusely reflect substantially all wavelengths of visible light. For example, light ray 644 can enter from top surface 604 and reflect off a portion of metal oxide particles 630 at a first angle. Light ray 646 can enter top surface 604 and reflect off a different portion of metal oxide particles 630 at a second angle different from the first angle. In this way, the metal oxide particles 630 within barrier layer 606 and porous anodic layer 612 can act as a light scattering medium for diffusing incident visible light entering from top surface 604, giving barrier layer 606 and porous anodic layer 612 and part 400 an opaque and white appearance Flowchart 700 indicates an anodizing process for forming an anodized film with branched pores and infused metal complexes, such as shown in FIG. 6. Prior to the anodizing process of flowchart 700, the surface of a substrate can be finished using, for example, a polishing or texturing process. In some embodiments, the substrate undergoes one or more pre-anodizing processes to clean the surface. At 702, branched structures and pores are formed within a protective anodic layer over a substrate. At 704, the branched structures and pores are infused with metal complexes. Once within the pores, at 706, the metal complexes can undergo a chemical reaction to form metal oxide particles that can diffuse incident visible light, thereby imparting an opaque and white appearance to the porous anodic film and the substrate. At 708, the branched structures and pores of the porous anodic film are optionally sealed using a sealing process.

Note that after any of the processes of flowcharts 300, 500, and 700 are complete, the substrates can be further treated with one or more suitable post-anodizing processes. In some embodiments, the porous anodic film is further colored using a dye or electrochemical coloring process. In some embodiments, the surface of the porous anodic film is polished using mechanical methods such as buffing or lapping.

In some embodiments, portions of a part can be masked prior to one or more of the whitening processes described above such that the masked portions of the part are not exposed to the whitening processes. For example, portions of the part can be masked off using a photoresist material. In this way, portions of the part can have a white anodic film and other portions can have a standard translucent anodic film.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A method for providing a white appearance to an anodic film, the anodic film comprising anodic pores with pore openings at an external surface of the anodic film, the method comprising:

widening the anodic pores in a first electrolyte;

infusing titanium oxide complex anions into the anodic pores in a second electrolyte, wherein the titanium oxide complex anions migrate toward pore terminuses of the anodic pores positioned opposite the pore openings, wherein at least a portion of the infused titanium oxide complex anions are converted into titanium oxide particles at the pore terminuses.

2. The method of claim 1, wherein the first electrolyte is a weakly acidic solution.

3. The method of claim 2, wherein the weakly acidic solution comprises a metal salt.

4. The method of claim 1, further comprising exposing the anodic film to a sealing process to seal at least a portion of the anodic pores.

5. The method of claim 1, wherein the titanium oxide complex anions include titanium (IV) oxide complexes.

6. The method of claim 5, wherein converting the infused titanium oxide complex anions comprises converting the titanium (IV) oxide complexes to titanium dioxide.

7. The method of claim 1, wherein infusing the titanium oxide complex anions within the anodic pores comprises exposing the anodic film to an electrolytic process whereby the titanium oxide complex anions are driven toward an underlying metal surface adjacent the pore terminuses.

8. A method of providing a white coating on a metal substrate, the method comprising:

forming an anodic film on the metal substrate by anodizing the metal substrate in a first electrolyte, the anodic film having anodic pores;

widening at least a portion of the anodic pores by exposing the anodic film to a pore-widening process; and performing an ion infusing process on the anodic film within a second electrolyte different than the first electrolyte, the ion infusing process involving attracting titanium oxide complex anions from the second electrolyte toward pore terminuses of the anodic pores, wherein at least a portion of the titanium oxide complex anions form titanium oxide within the anodic pores.

9. The method of claim 8, wherein the titanium oxide conforms to a shape and size in accordance with corresponding anodic pores.

10. The method of claim 8, wherein the titanium oxide complex anions include titanium oxide (IV) anions.

11. The method of claim 10, wherein forming the titanium oxide comprises converting the titanium oxide (IV) anions to titanium dioxide.

12. The method of claim 10, wherein the titanium oxide (IV) anions are formed by providing $Ti(OH)_2[OCH(CH_2)COOH]_2$ and $C_3H_8O$ in the second electrolyte.

13. The method of claim 8, further comprising:

after forming the titanium oxide within the anodic pores, closing openings of the anodic pores using a sealing process.

14. A method of forming an anodic film having a white appearance, the method comprising:

forming the anodic film in a first electrolytic bath, wherein the anodic film has anodic pores; and infusing titanium oxide complex anions into at least a portion of the anodic pores by immersing the anodic film in a second electrolytic bath having the titanium oxide complex anions and applying a voltage to the second electrolytic bath, the second electrolytic bath different than the first electrolytic bath, wherein the second electrolytic bath contains hydroxide ions ($OH^-$) that react with the infused titanium oxide complex anions, thereby forming titanium oxide within at least a portion of the anodic pores.

15. The method of claim 14, further comprising sealing the anodic pores.

16. The method of claim 14, wherein the titanium oxide complex anions include $[TiO(C_2O_4)_2]^{2-}$.

17. The method of claim 14, wherein the titanium oxide complex anions are titanium (IV) oxide anions.

18. The method of claim 14, wherein the titanium oxide complex anions are formed by adding titanium oxysulfate ($TiOSO_4$) and oxalic acid ($C_2H_2O_4$) in the second electrolytic bath.

19. The method of claim 14, wherein the titanium oxide complex anions are formed by adding $Ti(OH)_2[OCH(CH_3)COOH]_2$ and $C_3H_8O$ in the second electrolytic bath.

20. The method of claim 14, wherein the second electrolytic bath has a temperature ranging between about 10 degrees C. and 80 degrees C.

21. The method of claim 14, wherein the second electrolytic bath has a pH ranging between about 1 and 7.

* * * * *